United States Patent [19]

Vermes et al.

[11] 4,040,618

[45] Aug. 9, 1977

[54] SHEET STACKING APPARATUS

[75] Inventors: Roy E. Vermes, Southwick; Richard E. Cosby, Feeding Hills, both of Mass.

[73] Assignee: Revco, Inc., Agawam, Mass.

[21] Appl. No.: 678,318

[22] Filed: Apr. 19, 1976

[51] Int. Cl.[2] ..... B65H 29/68

[52] U.S. Cl. ..... 271/182; 271/202; 271/215; 271/217

[58] Field of Search ..... 271/174, 176, 182, 183, 271/189, 190, 202, 215, 217

[56] References Cited

U.S. PATENT DOCUMENTS

| | | | |
|---|---|---|---|
| 2,919,789 | 1/1960 | Coakley | 271/183 X |
| 3,481,598 | 12/1969 | Lopez | 271/202 X |
| 3,547,024 | 12/1970 | Lopez | 271/202 X |
| 3,643,940 | 2/1972 | Lopez | 271/202 |
| 3,724,840 | 4/1973 | Kuckhermann | 271/182 |
| 3,791,269 | 2/1974 | Sawada | 271/202 X |

*Primary Examiner*—Richard A. Schacher

*Attorney, Agent, or Firm*—Chapin, Neal and Dempsey

[57] ABSTRACT

Sheet stacking apparatus having a variable speed conveyor on which sheets are carried in partially overlapped or "shingled" relation and deposited onto a second variable speed conveyor disposed in end-to-end relation to the first conveyor for receiving sheets therefrom and projecting onto a vertically movable stacking conveyor which lowers automatically as the stack builds up. Feed stop mechanism is disposed to stop and release selectively the flow of sheets from the first conveyor onto the second conveyor in response to the "full stack" position of the stacking conveyor. Control means is provided for changing the speed of the two conveyors in sequential relationship to the actuation of the stop mechanism whereby the speed of the first conveyor is substantially reduced, while the speed of the second conveyor is substantially increased to clear the latter preparatory to discharge of the stacking conveyor. Control means also operates to release the stop mechanism and return the conveyors to normal speed upon return of stacking conveyor to sheet receiving position.

9 Claims, 15 Drawing Figures

Fig. 3.
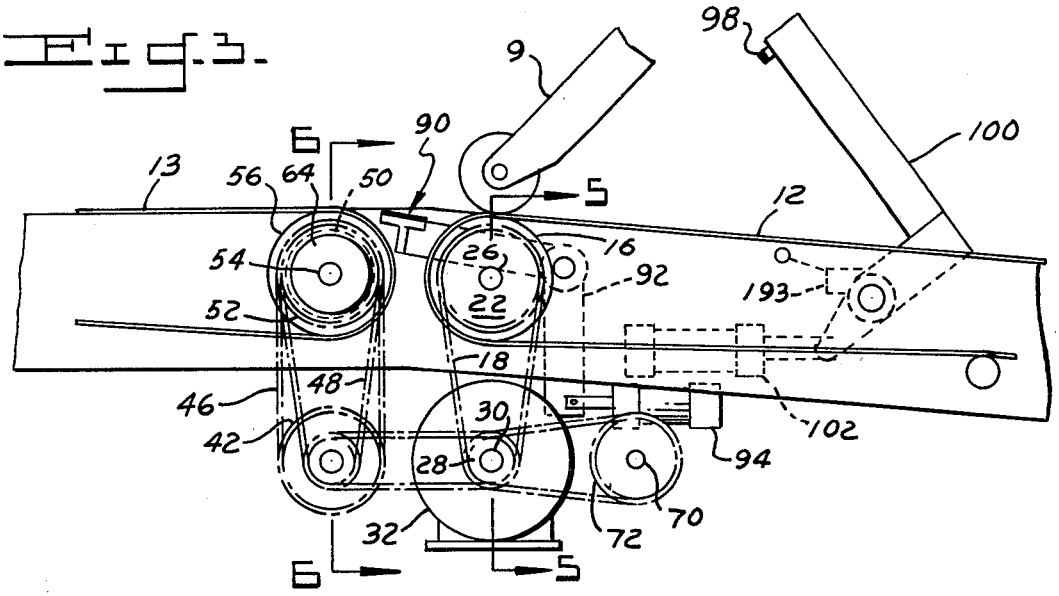
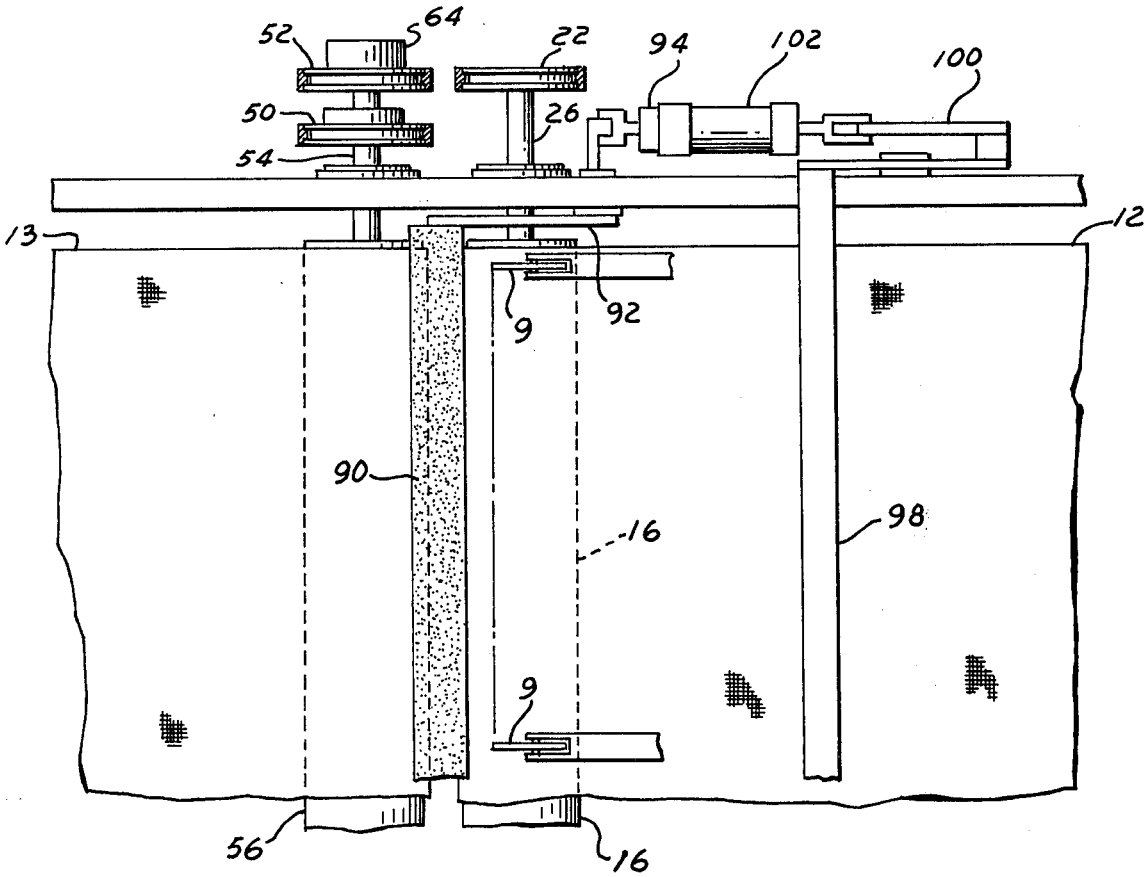
Fig. 4.

Fig. 5.
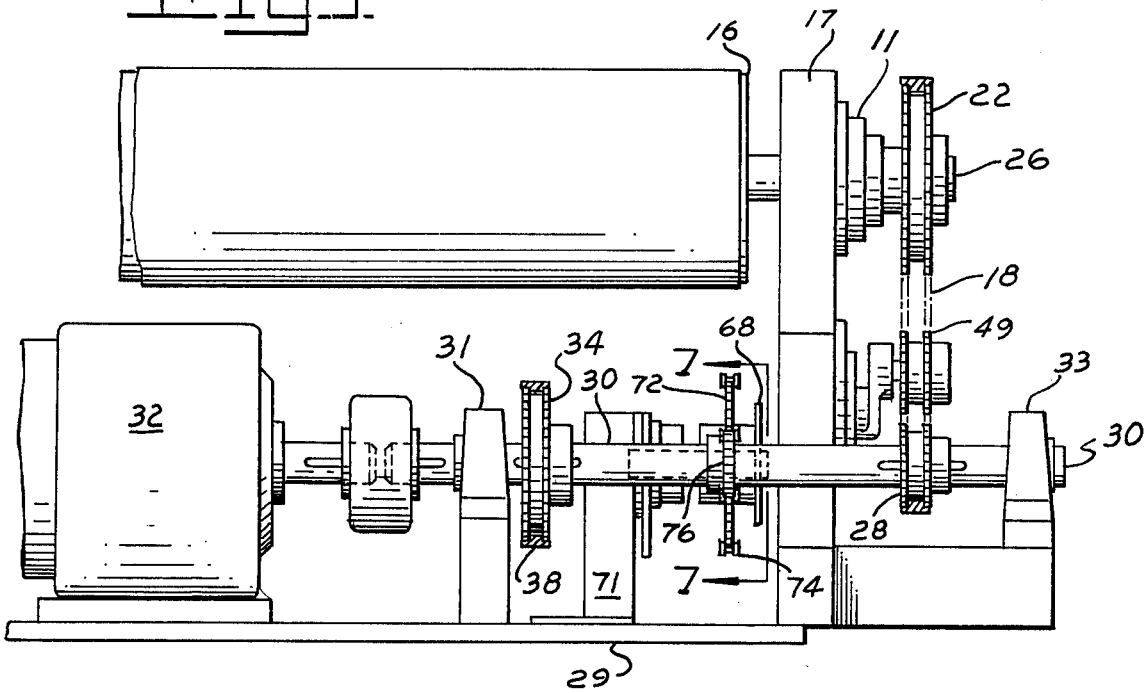
Fig. 6.
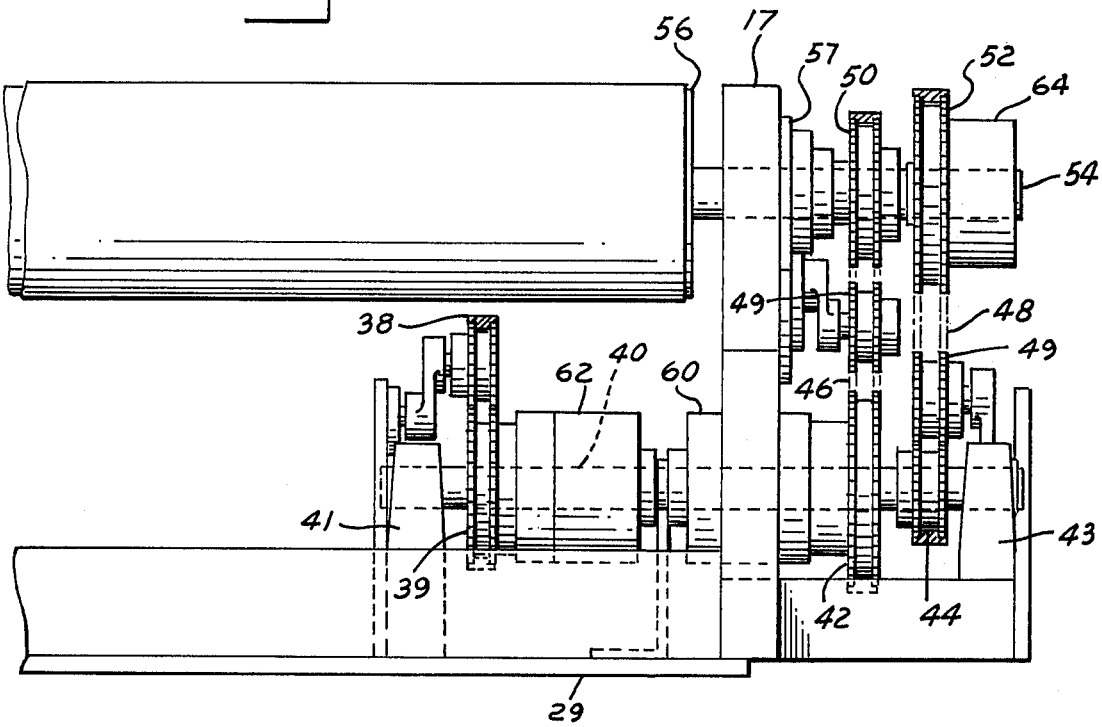
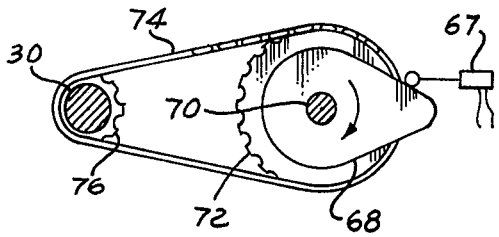
Fig. 7.

SHEET STACKING APPARATUS

BACKGROUND

Equipment has been available for sometime for the stacking of corrugated cardboard sheets, such as supplied by a cutting machine, referred to in the trade as a "corrugator". Such equipment is generally constructed to convey the corrugated sheets to a stacking station where the sheets are stacked in superposed relation. When the stack reaches a predetermined height, it is transferred by any suitable means to another location, such as for shipment to a purchaser or to a box cutting machine in the same plant. Such stacking equipment generally includes an abutment stop mechanism by which the sheet flow is stopped for the interval of time during which the completed stack is removed from the stacking station and the station is readied to receive the first of another stack of sheets. The interruption in the supply of sheets to the stacker, of course, results in a backup on the feed conveyor leading to the stop mechanism, such pile ups usually tend to be unstable, particulrly with high speed equipment and when the sheets are relatively large and bulky. Not infrequently, backup of large corrugated fiber board sheets will become unstable and skew or shift on the conveyor so that upon the release by the abutment stop mechanism and resumption of the feed cycle, the sheets which make up the pile will become misaligned and cause improper stacking, the result being that shut-downs for operator corrective action have all too frequently been required.

The principal object of this invention is to provide a high speed feeding and stacking mechanism for corrugated sheets which is capable of efficiently stacking without the drawbacks of the equipment heretofore available.

The above and other objects and advantages of the invention will be more readily apparent from the following description and with reference to the accompanying drawings, in which:

FIG. 3 is a partial elevational view on an enlarged scale showing the control mechanism used in the apparatus of FIG. 1;

FIG. 4 is a partial plan view similar to FIG. 3;

FIG. 5 is a section taken along line 5—5 of FIG. 3;

FIG. 6 is an elevational view taken along line 6—6 of FIG. 3;

FIG. 7 is a section taken along line 7—7 of FIG. 5;

Figure 8:
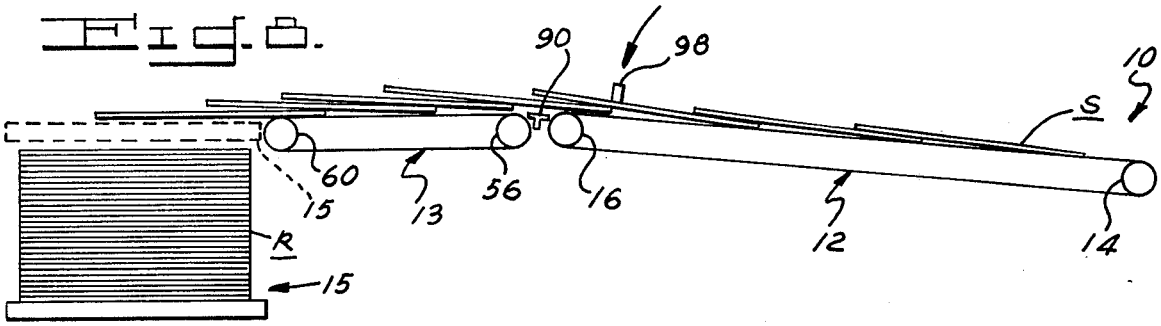
FIGS. 8-11 are diagrammatical views illustrative of the operation sequence of the apparatus embodying this invention.
Figure 9:
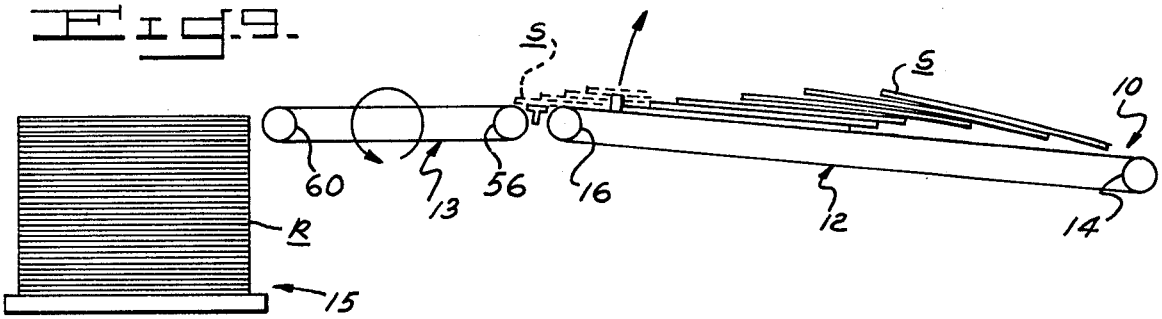
Figure 10:
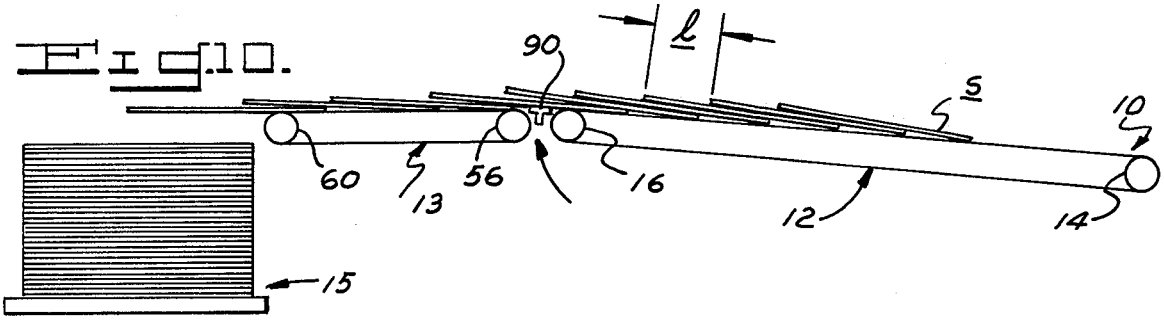

Referring in detail to the drawings, a sheet delivery and stacking conveyor is shown generally in FIGS. 1, 2 and 8-11. Corrugated board or sheets *s* are supplied to the receiving end 10 of an upwardly inclined endless conveyor belt 12 on which the sheets are carried in shingled relation, that is, each succeeding sheet lags behind the preceding sheet by a distance *l* (FIG. 10). Pivotable laterally spaced hold down rollers 9 are provided at both ends of conveyor 12 to urge the sheets onto the surface of the conveyor. If necessary or desirable, the rollers may be motor driven. The speed of the shingling conveyor 12 is controlled as will hereinafter be disclosed to maintain the desired shingle length *l* regardless of the speed of the sheet supply "corrugator". A generally horizontal transfer conveyor 13 is disposed in end-to-end relation adjacent the upper end of the conveyor 12 and receives the sheets therefrom. A set of laterally spaced hold down rollers 9 is disposed at the outlet end of conveyor 13 as well as at the inlet and outlet ends of conveyor 12 to insure smooth transfer of sheets from one conveyor to the other and also onto stacking conveyor 15. Conveyor 13 is only about one fourth the length of shingling conveyor 12 and serves to carry the sheets received from conveyor 12 and project them into platform 15 which automatically lowers as the sheet stack *k* increases in height, as will hereinafter be described. The belts or conveyors 12 and 13 may be fabricated of any durable, flexible material fitted over longitudinally spaced rollers whereby the belts are tensioned so that one roll of each conveyor may serve as the drive roll. The composition of which the belts of conveyors 12 and 13 are fabricated is such as to provide coefficients of friction so that corrugated sheets will be carried by frictional contact only.

Conveyor 12 is supported at its inlet end by idler roll 14 and a motor driven roll 16 at its outlet end. Rolls 14 and 16 are supported at opposite ends by bearings 11 (FIG. 5) mounted on said frame member 17. A drive chain 18 meshed with sprocket 22 fixed to rotate shaft 26 by which the roll 16 is carried. Drive sprocket 28, also meshed with chain 18, is affixed to shaft 30 driven by variable speed electric motor 32 (FIG. 5) supported on a base plate 29. The speed of motor 32 is controlled by an electronic control unit 132 (FIG. 15) with input from variable potentiometer 134, so that the shingle length *l* between sheets carried by conveyor 12 will be maintained substantially constant as previously mentioned. A tach generator 136 supplies an electrical input to control unit 132 which is a function of the speed of the corrugator which supplies sheets to the inlet end of the conveyor 12. An electrical signal is also provided by "tach generator" 138 which signal varies as a function of the speed of motor 32. An eddy current clutch 139 is also provided for reducing the speed of motor 32 to about one-half shingling speed. Low speed is used for the time interval during which a completed stack *k* is being removed from the platform 15. A limit switch 168 (FIGS. 2 and 15) which is actuated when the stacking platform reaches a predetermined level and provides a signal to relay 176 to initiate discharge of the stack and low conveyor speed for the transfer cycle. During this interval, a stop or interrupter means at the top of the conveyor 12 interrupts the sheet flow to conveyor 13 and platform 15, as will hereinafter be more fully described.

Rotation of main drive shaft 30 by motor 32 is transmitted by a sprocket 34 splined to the shaft 30 (FIG. 5) and a chain 38 meshed with a similar sprocket 39 (FIG. 6) affixed to drive shaft 40. Shaft 30 is supported by axially spaced bearings 31 and 33 and shaft 40 is similarly supported by axially spaced bearings 41 and 43.

Drive roll 56 of the conveyor 13 is supported by bearings 57 (one shown in FIG. 6) on opposite sides of frame members 17. Two sets of selectively usable transmission means are provided for rotating the shaft of drive roll 56. Sprockets 42 and 44 of different diameter are engaged with drive chains 46 and 48 which in turn rotate sprockets 50 and 52 carried on shaft 54, whereby the drive roll 56 of the short conveyor 13 is driven at noraml or high speed during different operational phases of the stacking apparatus. Pivotable sprockets 49 (FIGS. 5 and 6) are provided for properly tensioning the drive chains 18, 46 and 48. Clutch mechanisms 60 and 62 on shaft 40, which are operated by control relays 161 and 163 (FIG. 15), selectively control the speed of transfer conveyor 13.

The short conveyor 13 is disposed in end-to-end relation from the output end of the conveyor 12 and is spaced therefrom by a slight gap. Conveyor 13 is generally horizontal and approximately the same width as the shingling conveyor 12 and also includes an endless belt which is tensioned over a pair of longitudinally spaced rollers 56 and 60 for frictionally carrying corrugated sheets. Shaft 54 may be driven either from sprocket 42 at high speed or sprocket 44 at normal or regular speed which is the case when sheets are being transferred from conveyor 12 to the stacking platform 15 by conveyor 13 which functions as an intermediate transfer apparatus to receive sheets from the inclined shingling conveyor, reorient them to the horizontal so they are approximately coplanar with the upper surface of platform 15 and to project the sheets onto the platform or the top sheet of the stack *k.* Pneumatic clutch mechanism 60 causes selective engagement of sprocket 42 and drive shaft 40. This results in sprockets 42 and 50 rotating shaft 54 and the drive roll 56 at a substantially higher rate of speed than is the case when sprockets 44 and 52 are cooperating to drive shaft 54. During high speed rotation of shaft 54, sprocket 44 will continue to drive low speed sprocket 52, but an override mechanism in the form of a slip clutch 64 is provided to avoid damage to the low speed transmission. High speed operation of the drive roll 56 and belt 13 occurs in proximate timed relation with operation of the sheet stop mechanism as described below and continues for one-half revolution of the transfer conveyor 13, after which all sheets will have been cleared onto the stacking conveyor 15. During this time, a point on the belt of conveyor 13 will have traveled a distance slightly greater than the spacing between roll 56 and roll 60.

Figure 15:
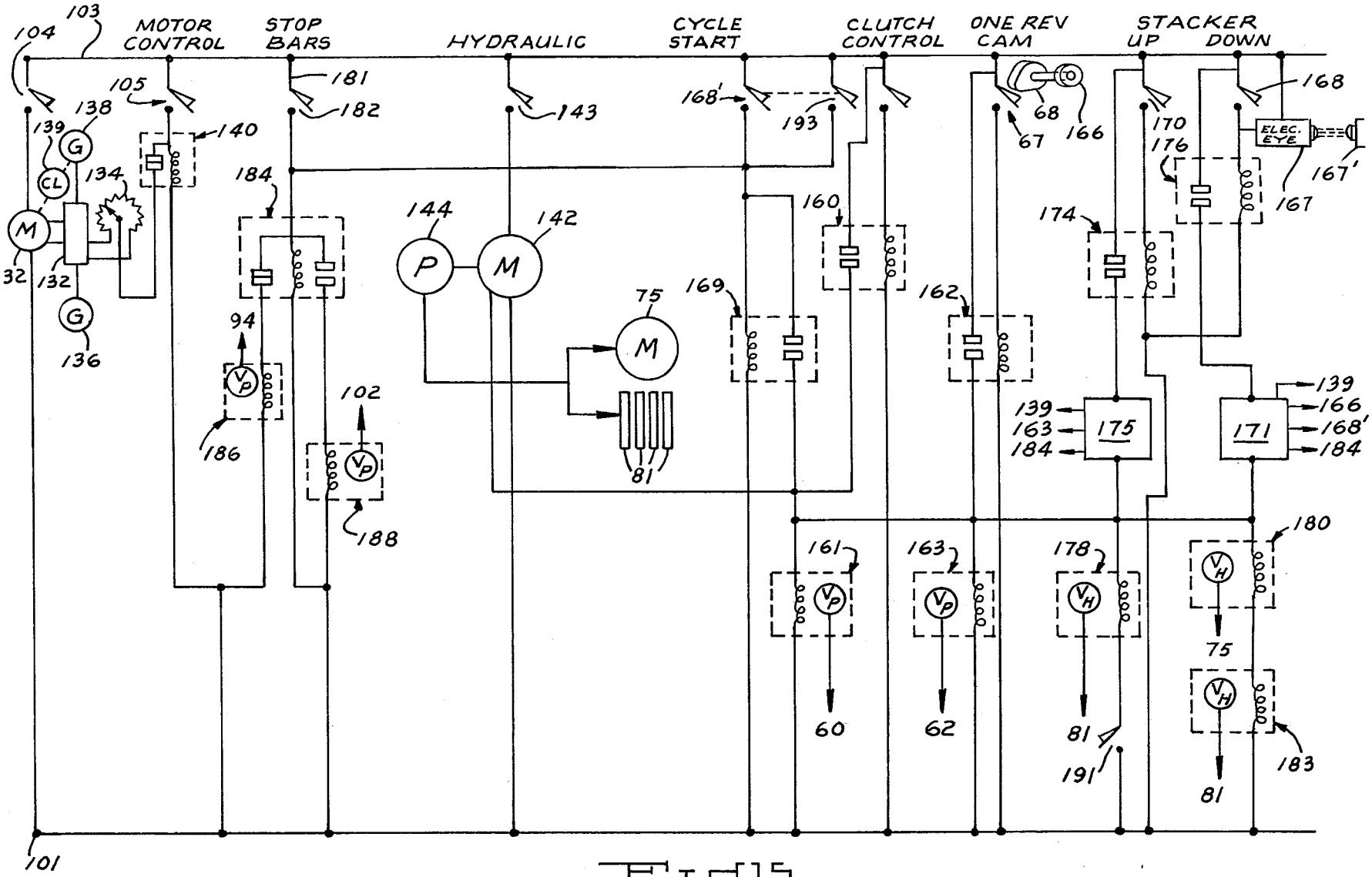
FIG. 15 is a simplified diagrammatic view of an electrical control circuit suitable for controlling the operation of apparatus embodying this invention.

The high speed operation of the conveyor 13 is controlled by a limit switch 67 actuated by a rotatable cam 68 (FIGS. 7 and 15). The cam is mounted on a shaft 70 parallel to drive shaft 30 and is supported by a mounting bracket 71 which extends upwardly from base plate 29. The cam 68 is rotated by sprocket 72 engaged by a chain or belt 74 driven by sprocket 76 carried by the drive shaft 30. A clutch 166 (FIG. 15) is operable by an electrical signal to actuate the cam for interengagement thereof with the rotating shaft 70. When the clutch 166 is actuated, the single lobe cam 68 is rotated until the cam makes approximately one revolution and its high point operates limit switch 67. One revolution of cam 68 causes slightly more than one-half revolution of conveyor 13. This provides an electrical signal to relay 162 (FIG. 15) to actuate a solenoid valve 163 whereby pneumatic clutch 62 (FIG. 6) on shaft 40 is actuated to disengage both transmission sprockets 42 and 44 from sprocket 39 which drives shaft 40.

Upon completion of a stack *k* on the stacking platform 15, the platform will have automatically been lowered incrementally by an electric eye 167 (FIGS. 1 and 15) which senses the top of the stack and provides a signal to hydraulic valve relay 176 by which the platform is lowered automatically until it reaches a predetermined level at which a limit switch 168 is actuated which starts the stack transfer cycle. During this stack transfer phase of operation, sheet interrupter means is actuated to stop transfer of sheets to the stacker when it is discharging a completed stack. The interrupter means takes the form of interrupter bars 90 and 98 (FIG. 3), as will hereinafter be more fully described. After stack discharge, upon return of the platform to the level of conveyor 13, limit switch 170 is actuated to cause resumption of the normal stacking operation.

The stacking unit is located at the terminal end of the conveyor 13 and comprises a platform 15 vertically movable to and from a position approximately in the same plane as the upper surface of the conveyor 13. The stacking unit comprises a fixed framework of upright posts 79 and box beams 80 longitudinally and laterally arranged into an openwork box frame. The vertically movable platform 15 is disposed within the frame and includes at each corner a hydraulic ram 81 which raise and lower the platform as controlled by solenoid operated hydraulic valves 178 and 183 (FIG. 15). A longitudinally adjustable backboard 82 is supported by a beam 83 which extends across the platform from one side beam 80 to the other. The backboard serves to stop forward movement of the sheets *s* as they are projected from conveyor 13 onto the upper surface of the platform and/or the top of the stack *k.* The backboard may be adjustable longitudinally and if desired its movement may be motorized to accommodate stacking of different length sheets. The backboard may be supported by laterally spaced bars slidably carried by beam 83 to slide vertically downward as the platform is lowered and to be raised by the platform.

Figure 13:
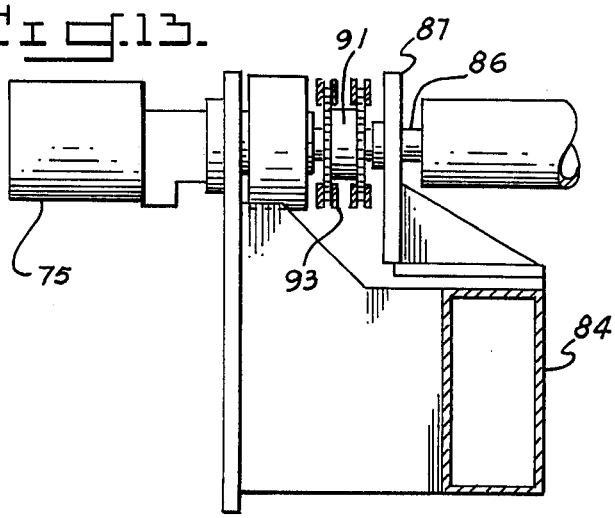
FIG. 13 is a section on an enlarged scale taken along line 13—13 of FIG. 1.
Figure 14:
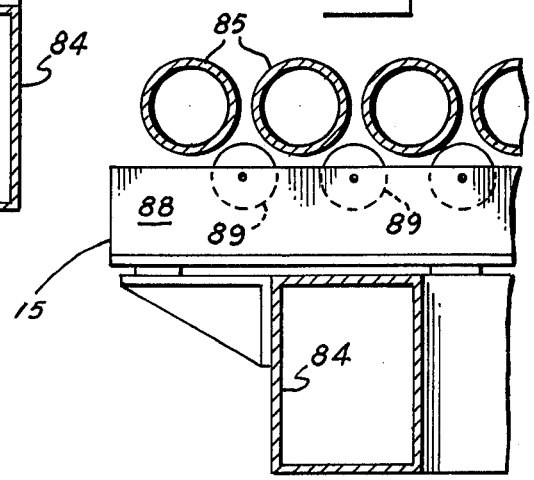
FIG. 14 is a section on an enlarged scale taken along line 14—14 of FIG. 1.

The platform 15 comprises a rectangular beam frame made up of longitudinal and transversely oriented box beams 84 (FIGS. 13 and 14). Laterally spaced parallel rollers 85 provide the sheet supporting surface of the platform 15. The rollers include a shaft 86 at opposite ends thereof which extend through plates or brackets 87 which are carried on the movable frame 84. An intermediate support bracket 88 extends laterally across the center of the platform from one side of the frame 84 to the other. A plurality of spaced wheels 89 (FIG. 14) are rotatably mounted on the bracket 88 and provide bearing support for the rollers 85 at about the midpoint of their length. At one end, the support shaft 86 (FIG. 13) of each roll is fitted with a sprocket 91 (one of which is shown) and a suitable drive means, such as by a link chain arrangement as shown at 93. Clockwise or counterclockwise rotation of each roll 85 results as hydraulic drive motor 75 is energized, depending on its direction of rotation. Pressurized hydraulic fluid is provided motor 75 and pump 142 (FIG. 15) and hydraulic solenoid valve 180 controls the flow of the fluid to motor 75.

When the upper surface of the platform comprising rollers 85 is positioned at about the same level as the upper surface of conveyor 13, it is ready to receive the first of a multiplicity of corrugated sheets *s* being delivered in shingled relation by the conveyor 13. As the sheets flow onto the platform their leading edge will strike the backboard 82 adjacent to its lower edge and they will settle in edge-to-edge superposed relation to form a uniform stack.

Figure 2:
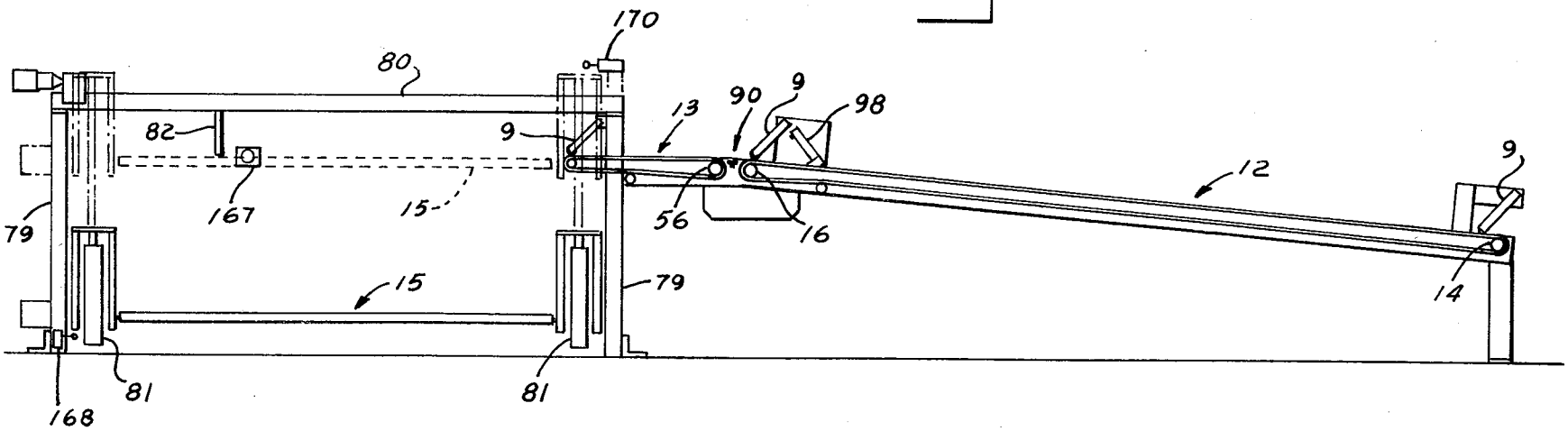
FIG. 2 is a side elevational view of the apparatus shown in FIG. 1.

An electric eye 167 and its reflector target 167' are disposed on opposite sides of the platform and provide electrical signals to relay 176, to energize solenoid valve 183 which, as the stack height increases, controls the flow of hydraulic fluid to the corner rams 81 from pump 144 to automatically lower the platform. When the platform has lowered to its predetermined lower limit, such as shown in FIG. 2, a limit switch 168 is operated. Solenoid valve 180 provides pressurized hydraulic fluid to motor 75 and rollers 85 are all driven by a sprocket and chain arrangement as illustrated at 91 and 93 in FIG. 13. Thus the stack *k* is automatically discharged from the platform 15 onto a suitable transport mechanism or transversely oriented conveyor. When the stack has been discharged, a limit switch, such as illustrated at 191 (FIG. 15) is actuated to cause solenoid 178 to provide hydraulic fluid to rams 81, whereby platform 15 is raise to its uppermost position, as shown in the dotted line position of FIG. 2. Limit switch 170 (FIGS. 2 and 15) is appropriately positioned to be actuated when the platform approaches coplanar relation with the transfer conveyor 13. This limit switch provides an impulse to electronic controller 175 which provides output signals to relay 184 to cause the stop bar 90 to be lowered to clutch 139 whereby motor 32 returns to its normal speed, and relay 163 whereby clutch 62 is deactuated and drive roll 56 is shifted to normal speed.

Interrupter means is provided at the upper or outlet end of the shingling conveyor 12 to arrest the flow of sheets from conveyor 12 to transfer conveyor 13. As previously indicated, switch 168' is the cycle start switch and may be operated either manually or automatically and its operation may be sequentially tied into operation of limit switches 168 and 193 and switch 182, as will be described.

Relay 184 is energized by operation of switch 182, and pneumatic solenoid valve 186 will cause a stop bar 90 located in the gap between the conveyors to be raised. This is accomplished when solenoid 186 provides pressurized air to cylinder 94. This results in interruption of the flow of sheets from conveyor 12 to transfer conveyor 13. Substantially simultaneously, motor control relay 140 will be actuated so that potentiometer 134 will vary its input to electronic control unit 132 and the speed of motor 32 will be reduced. Also at this time, clutch 60 is actuated by solenoid valve 161 controlled by relay 169 whereby sprockets 42 and 50 drive roll 56 at high speed. Clutch 166 is also energized whereby cam 68 is caused to rotate one revolution and trip limit switch 67 (FIGS. 7 and 15) to cause clutch 62 to disconnect when solenoid 163 is actuated. As a result, drive sprocket 38 is disengaged from the shaft 40 so that drive roll 56 and conveyor 13 stops.

Sheet engaging bar 90 interposed in the gap (FIG. 3) provided between the conveyors 12 and 13 extends laterally across the width of the machine and is supported at each of its outer ends by pivotable crank arm 92 which is moved by pneumatic cylinders 94 supported by the side rails on both sides of the machine. Air to the cylinders 94 is controlled by relay 184 and solenoid valve 186 (FIG. 15). The upper surface of the bar 90 is preferably coated or surfaced with a material which has a much higher coefficient of friction than that of conveyor 12. It has been found that a strip of soft rubber on bar 90 will frictionally grip and hold any sheet being advanced thereover by conveyor 12 at its maximum available feed rate. Thus upon actuation of bar 90, a sheet which is passing over the bar 90 will be raised slightly and frictionally gripped by the bar. Thereafter, the belt of conveyor 12 will slip relative to the sheet which has been stopped by the bar. Succeeding sheets will still be moved by the conveyor 12 and will accumulate on the stopped sheet with ever decreasing shingle length *l*. In addition to the bar 90, the stop means of this invention includes a second stop or interrupter bar 93 for use with sheets substantially greater in length than conveyor 13.

With such long sheets it is possible that upon the friction bar 90 being raised, the tail end of a sheet will be caught and frictionally held by the bar 90 as the completed stack is being discharged from the stacking conveyor. The extent of overhang of a sheet so held and its unsupported weight will sometimes result in the sheet breaking and possibly jamming the continued operation of the equipment. In such cases, bar 98 is employed.

The bar 98 extends across the upper surface of the conveyor belt 12 and is supported at its outer ends by pivotable cranks 100. At each side of the machine a pneumatic cylinder 102 is provided, which upon actuation will pivot the crank 100 to swing the lower edge of the bar 90 toward the upper surface of the conveyor 12 into contact with the upper surface of a sheet moving under the bar at the time it is lowered. Any sheets whose leading edge is behind the lowered bar 98 will, of course, be positively stopped by direct force of abutment with the bar 98 and thus will not be transferred to the upper surface of the conveyor 13. Relay 184 causes pneumatic solenoid valve 188 to be actuated to provide pressurized air to cylinders 102 for raising and lowering the bar 98. Limit switch 193 (FIGS. 3 and 15) is provided adjacent the crank 100 so that an electrical impulse is generated when the lower edge of bar 98 moves into contact with conveyor 12. This will occur when the sheets caught under the lower edges of bar 98 have been cleared by the conveyor belt.

When the sheets caught below the edge of bar 98 (FIG. 8) have been cleared onto the transfer conveyor 13, they are projected onto the completed stack *k* and platform 15 will be lowered. As the sheets are cleared from between the bar 98 and the conveyor 12, the bar will drop into contact with the conveyor 12 and limit switch 193 will be actuated to provide an electrical impulse to cause relay 184 and solenoid valve 188 to actuate, whereby compressed air to cylinder 102 will cause bar 98 to be raised to its FIG. 3 position, and the sheets behind bar 98 will be released and carried by conveyor 12 toward bar 90. Limit switch 193 in this mode of operation also provides a cycle start signal by which switch 168' is actuated and functions in this mode in much the same manner as did switch 168 in the normal mode of operation. Stop bar 90 is raised and conveyor 13 is also shifted in high speed operation and conveyor 12 into low speed operation as previously described. The bottom and leading sheet carried by conveyor 12 will move until frictionally gripped by the rubber surface of the now raised bar 90. Thereafter, succeeding sheets carried by conveyor 12, now moving at a slow rate, will gradually accumulate behind the bar 90 and will pile up on the bottom sheet. The shingle length *l* between successive sheets will be greatly diminished. For example, the shingle length may be reduced to a matter of 2–6 inches (FIG. 9), while normally it may be on the order of 18–24 inches (FIG. 8). After the completed stack *k* has been discharged from the platform 15 and the platform is returned to its coplanar relation with the conveyor 13, limit switch 170 will cause hydraulic valve 178 to stop hydraulic flow to the platform rams 81, whereby the platform 15 stops. A signal to the motor control relay 140 causes the conveyors 12 and 13 to resume normal speed and stop bar 90 to be lowered. Limit switch 105 suitably located and connected in circuit with potentiometer 134 and relay 186 provides such a signal. When this sequence occurs, the accumulated stack of now closely sheets is released by the friction bar 90 and advances onto the transfer conveyor 13 without skewing or misalignment.

A significant feature of this invention is the provision of a frictionally operable stop bar 90 which is disposed between the two conveyors combined with stop bar 98 by which sheet flow is stopped by abutment therewith. In operation, the bar 90 frictionally engages the underside of the sheets across their full width while at the same time the conveyor belt, which is supplying the sheets in shingled relation, is reduced in speed and readily slips under the sheet held frictionally by the bar 90 and the succeeding sheets. The sheet engaged by upraised bar 90 will not advance because the belt of conveyor 12 has a much lower coefficient of friction than the upper surface of stop pad 90. Stop bar 90 is used for all sheet lengths, while abutment bar 98 is used only in conjunction therewith for very long sheets, as previously stated. Stop bar 98 exerts only light downward pressure and has a lower edge or strip of very low coefficient of friction, such as polyethylene, or "Teflon", so that sheets caught thereunder are easily moved by belt 12 under the bar and onto the transfer conveyor 13 even though contacted by the lower edge of bar 98. In addition, the belt 12 will slide easily past the bar when the pad comes into contact and this insures against abrasion of the belt 12. Preferably, the belt of conveyor 13 will be selected to have a higher coefficient of friction that that of conveyor 12 so that the sheets will be projected against the backboard 82 of the stacker unit with sufficient force to insure accurate edge-to-edge stacking.

In FIG. 15 is shown a simplified schemmatic drawing of an electrical system suitable for controlling the integrated operation of conveyors 12 and 13, the sheet stacking platform 15 and the interrupter mechanisms disposed to arrest the flow of sheets from the shingling conveyor 12 to the stacking conveyor. The control system comprises a pair of electrical leads 101 and 103 connected to a suitable source of electrical energy. The main electric conveyor drive motor 32 is connected to the electrical energy source by switch 104 and electronic control unit 132 controls the speed of the motor and receives input signals from tach generators 136 and 138, as previously discussed. These tach generators are connected respecively to monitor the corrugator feed speed and the speed of conveyor 12. An eddy current clutch 139 is also connected to the motor 132 to control its operation and to decrease and increase speed of conveyor 12 in response to signals from limit switches 168, 170 and controllers 171 and 175. Relay 140 is connected by switch 105 to the energy source. Upon energization of this relay, either by manual or automatic means, potentiometer 134 provides a signal to the electric control unit 132 to control the speed of the conveyor motor 32.

Motor 142 (FIG. 15) drives a hydraulic pump 144 which supplies fluid under pressure to hydraulic motor 75 and hydraulic rams 81. The motor 75 drives the stacking rollers 85 for discharge of a completed stack of sheets and, as previously discussed, rams 81 raise and lower the stacking platform 15. Solenoid valves 180 and 183 control the flow of hydraulic fluid to the motor 75 and rams 81 in response to electrical control signals for proper sequential operation of the rollers and platform. Circuit 181 is connected across the power supply lines 101 and 103 and a switch 182 is provided for energization of control relay 184. The control relay 184 selectively actuated solenoid valve 186 which provides pressurized air to pneumatic cylinder 94 which raises and lowers the stop bar 90. In addition, the operation of solenoid valve 188 is controlled for supplying air to pneumatic cylinder 103 which operates upper stop bar 98.

The motor 142 is energized by switch 143. Limit switch 168 is located to be actuated when the platform 15 is lowered to its stack discharge position and relay 168' and control relay 169 are energized to provide control signals to pneumatic solenoid control valves 161 and 163, as well as to hydraulic solenoid control valves 178, 180 and 183. Solenoid valve 161 controlled by relay 160 provides a pneumatic signal to clutch 60 on shaft 40 by which the short belt 13 is driven at high speed during the discharge cycle. Solenoid valve 163 provides a pneumatic signal to clutch 62 which disconnects the drive to roller 56 to stop the short conveyor 13.

As previously indicated, rotation of the cam 68 operates limit switch 67 (FIG. 7) to energize clutch control relay 162. This relay provides a signal to solenoid valve 163 for disengaging clutch 62 after cam 68 has completed one revolution. Limit switch 168 and 170 provide electrical impulses for controlling actuation of control relays 174 and 176 and suitable control chasis 171 and 175 in these circuits provide signals to the various relays indicated. Relays 174 and 176 in turn control the operation of hydraulic solenoid control valves 178, 180 and 183. An electric eye 167 provides a signal to energize relay 176 which controls the hydraulic valve 183 whereby hydraulic fluis is supplied to rams 81 to lower the platform incrementally during stacking. Solenoid 178 controls rams 81 to raise the stacking platform after a completed stack has been discharged. Hydraulic solenoid control valve 180 provides hydraulic pressurized fluid to hydraulic motor 75 which rotates the platform rollers 85 to discharge a stack from the platform when the platform is in its lower position, as shown in FIG. 2.

Figure 1:
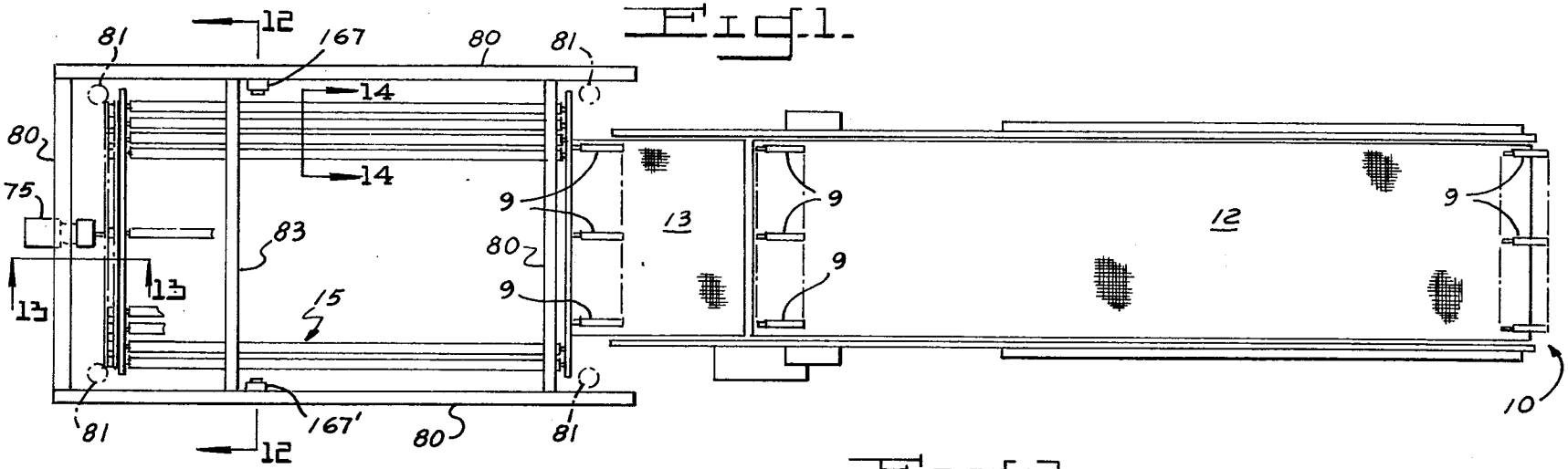
FIG. 1 is an overall plan view of a sheet delivery and stacking apparatus of the type embodying this invention.

Upon discharge of the stack, a limit switch 191 provides a signal which causes energization of the solenoid valve 178 whereby the platform is raised by rams 81. Electric eye 167 with its reflector 167' disposed on the opposite side of the platform, as shown in FIG. 1, provides an impulse to relay 176 to lower the platform 15 slowly so that the upper sheet *s* is maintained at generally the same level as conveyor 13 which projects sheets onto the platform 15.

In summarizing the operation of the machine embodying this invention, reference is made to FIGS. 8–11 which illustrate in diagrammatical form its operating sequences. Sheets are supplied to conveyor 12 by a feed corrugator and are carried by the inclined conveyor 12 in shingled or overlapped relation upwardly toward horizontal transfer conveyor 13, which has the same surface speed as the belt of conveyor 12. Hold down rollers 9 (FIGS. 1 and 2) provide for positive shingling of the sheets at the feed end of conveyor 12. The sheets are projected by transfer conveyor 13 onto the upper surface of the vertically movable stacker platform 15. Conveyor speed is controlled by electronic control unit 132 so that the shingle length *l* between successive sheets is maintained generally uniform despite variations in the speed of the feed corrugator. The stacker platform 15 is automatically lowered in response to electric eye 167 (FIG. 1) which senses the upper surface of the stack and provides impulses to control the operation of the hydraulic rams 81 whereby the platform is gradually lowered so that the upper surface of the stack is maintained at the same level as conveyor 13.

When the downstacker platform 15 has descended to a point where it supports a full "stack height", a limit switch detects this position and initiates a stack transfer cycle.

Figure 11:
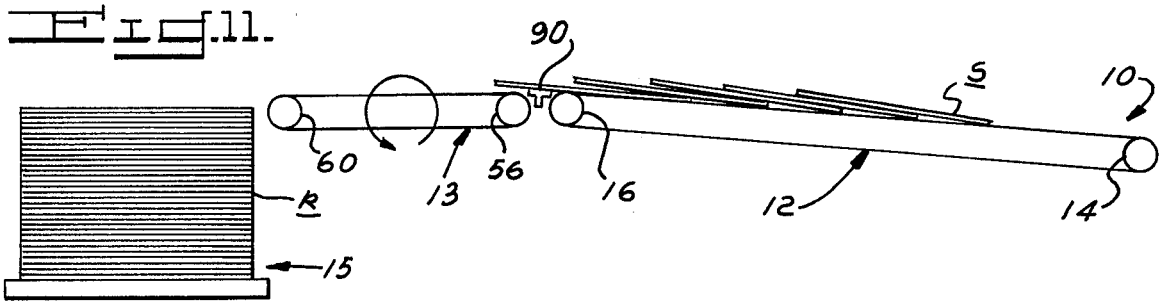
Figure 12:
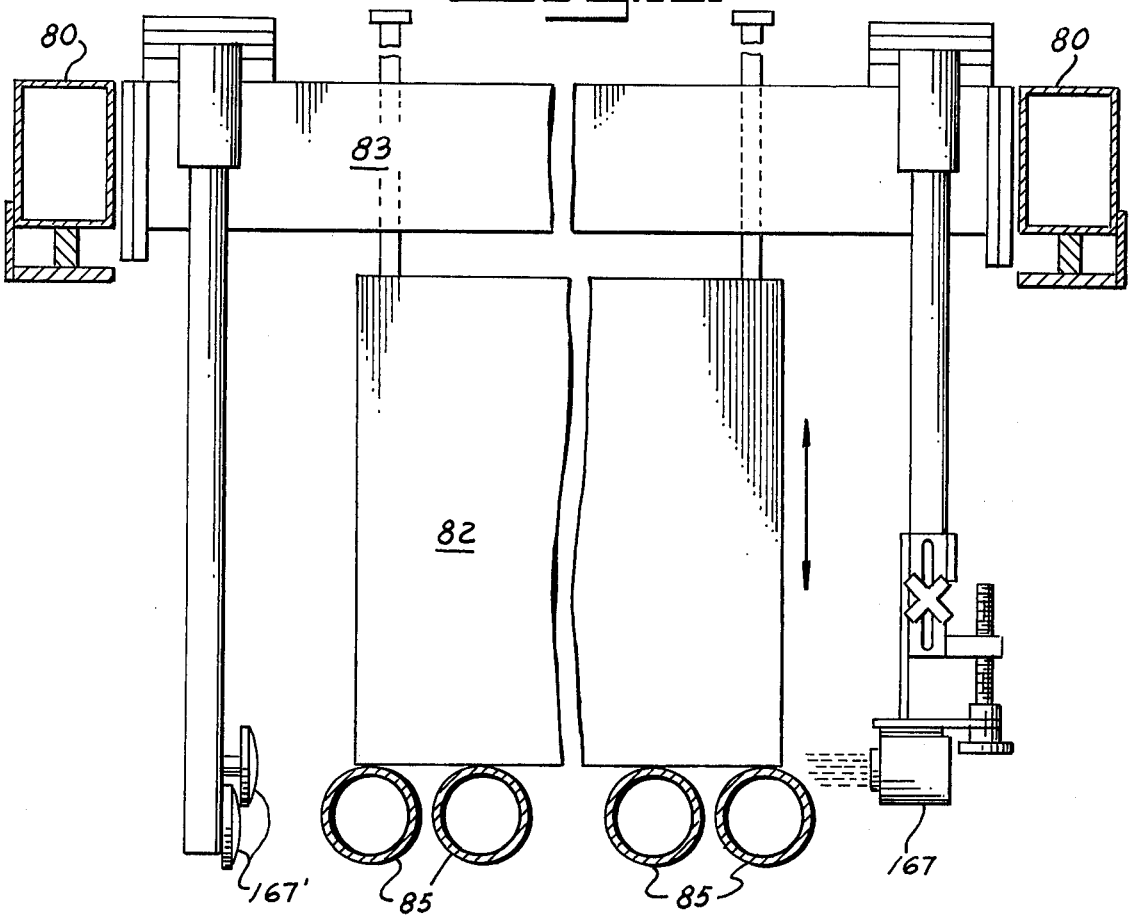
FIG. 12 is a section on an enlarged scale taken along line 12—12 of FIG. 1.

As shown in FIG. 10 and as previously described, a solenoid valve causes pneumatic cylinders to raise stop bar 90 located in the gap between the shingling and transfer conveyors. Except when stacking sheets much greater in length than the length of conveyor 13, the frictional interrupter bar 90 is the sole means used to interrupt the flow of sheets during the stack transfer cycle. The rubber pad of stop bar 90 frictionally engages the underside of the sheet passing over the gap between the two conveyors. Movement of the sheet is thereby stopped and at substantially the same time, conveyor 13 shifts to high speed mode and conveyor 12 shifts to low speed mode. At high speed, belt 13 quickly transfers onto the stack those sheets downstream of the raised interrupter bar 90. In the meantime, the belt of conveyor 12 moving at low speed continues to receive sheets from the corrugator and advance them at about one-half normal speed, toward the bar 90. In this way, an excessive pile up of sheets behind the stop bar is avoided. Rather, the sheets are slowly advanced relative to the sheet frictionally held by bar 90 and the shingle length *l* between successive sheets substantially decreases. After the conveyor 13 has made one-half a complete revolution, all sheets will have been cleared onto the downstacker, as shown in FIG. 11. At this time, conveyor 13 stops as previously discussed, while the conveyor 12 continues to move at its low speed mode. Discharge of the stack *k* from the platform is then initiated and, as previously described, the "live" rollers 85 which form the surface of the stacker platform are driven to move the stack on a discharge conveyor or other transfer mechanism. As soon as stack discharge is completed, the platform is raised to its sheet receiving position, as shown in dotted lines in FIG. 8, ready to receive the first of another stack of sheets. As the stacker platform approaches its sheet receiving position, a control signal causes retraction of stop bar 90 and return of both conveyors to their normal speed. On the retraction of the bar 90, the accumulation of sheets which had piled up behind the bar, such as shown by the dotted line illustration in FIG. 9, is transferred by conveyor 12 to conveyor 13 and then to stacker 15. The sheets are projected by conveyor 13 onto platform 15 where they are stopped by a backboard to start the formation of another stack. As the operation proceeds, the shingle length between successive sheets returns to normal, such as illustrated in FIG. 10.

For long sheets, the stop means used with the machine embodying this invention comprises not only the frictional stop bar 90 but a positive abutment stop bar 98. The cooperative action of these two mechanisms is illustrated in FIGS. 8 and 9. Whenever such long sheets are to be stacked, the machine is set for a modified sequence of operation. Upon completion of one stack of long sheets, as previously described, and upon initiation of the discharge cycle, the first action is the lowering of stop bar 98 which contacts the sheet passing thereunder. The stop bar 98 is adapted to exert only light downward pressure and its sheet engaging edge is characterized by a low coefficient of friction. Consequently, conveyor 12 continues to move such trapped sheet from under the bar and onto transfer conveyor 13. For example, those sheets shown in FIG. 8 which are under and to the left of the stop bar 98 are transferred onto the conveyor 13, while those sheets to the right of the bar 98, they will only move until the leading edge of the first sheet abuts the backside of bar 98. Succeeding sheets will advance relative thereto and gradually telescope to a tightly shingled pile. When the sheets to the left of bar 98 are cleared by the conveyor 12, the bar 98 will drop into contact with the belt of conveyor 12 and limit switch 193 will be actuated to raise bar 98 and cause essentially a repetition of the discharge cycle previously described for shorter sheets. As the bar 90 is raised, conveyor 13 will shift into high speed mode for one revolution and conveyor 12 will shift into low speed mode. The remainder of the discharge cycle is as previously described.

Having thus described the invention, what is claimed is:

1. Machine for stacking corrugated sheets and the like in superposed edge-to-edge relation comprising a shingling conveyor having a driven endless belt for frictionally carrying said sheets in shingled relation, a transfer conveyor disposed in spaced end-to-end relation with the shingling conveyor for receiving said sheets from the shingling conveyor and including a driven belt for supporting said sheets thereon and frictionally carrying said sheets, a vertically movable platform disposed to receive sheets from the transfer conveyor, means for lowering said platform from a position approximately coplanar with said transfer conveyor as the height of the stack thereon increases, said machine having an automatic stack transfer cycle when said stack achieves a predetermined height, means for controlling the speed of said shingling conveyor and said transfer conveyor and means operable for said stack transfer cycle for stopping movement of said sheets from the shingling conveyor onto the transfer conveyor and including means to arrest movement of said sheets while the belt of said shingling conveyor is moving, said speed control means including means reducing the speed of said shingling conveyor and increasing the speed of said transfer conveyor in relation to the actuation of the said stop means whereby sheets are continuously moved toward said stop means by said shingling conveyor and discharged at increased speed by the transfer conveyor onto said vertically movable platform during said stack transfer cycle.

2. Machine for stacking sheet material as set forth in claim 1 in which said vertically movable platform includes an upper surface formed by a plurality of laterally spaced rollers, the axes of said rollers being parallel to the feed direction of said conveyors, said rollers including means for rotating the same for discharge of a complete stack of sheets from said platform.

3. Machine for stacking sheet material as set forth in claim 1 in which said shingling conveyor is inclined upwardly and terminates at a height greater than the height of a stack to be formed by said machine, said transfer conveyor being generally horizontal, shorter in length than the shingling conveyor and spaced from the upper end of said shingling conveyor, means for driving the belts of both said conveyors at substantially the same surface speed during fomation of a stack of sheets on said vertically movable platform, the length of said transfer conveyor being sufficient to support the sheets being stacked.

4. Machine for stacking sheet material as set forth in claim 3 in which sheets are supplied to the lower end of said shingling conveyor by a corrugator and including means for monitoring the speed of said corrugator and providing a signal to said speed control means to control the speed of the shingling conveyor at a rate which is related to the speed of the corrugator so that the shingle length between successive sheets is maintained constant.

5. Machine for stacking sheet material as set forth in claim 3 and further including means for limiting the extent of travel at increased speed of the belt of said transfer conveyor to about one-half revolution of the latter belt.

6. Machine for stacking sheet material as set forth in claim 3 and in which said speed control means further includes means adapted to return said conveyors to normal speed in sequential relationship to the deactuation of said stop means.

7. Means for stacking sheet material as set forth in claim 3 in which said means to arrest movement of said sheets while the belt of said shingling conveyor is moving comprises a bar disposed in the space between the adjacent ends of the shingling conveyor and transfer conveyor and extending transversely of the sheet feeding movement of said conveyors, said bar being movable to and from a level above and below the path of said movement across the space between said conveyors, said bar having a sheet engaging surface of high coefficient of friction for engaging the underside of a sheet passing over said space when the bar is raised to a level above said path, the belt of said shingling conveyor having a coefficient of friction substantially less than that of the sheet engaging surface of said bar whereby the latter belt will continue to move relative to a sheet frictionally held by said bar.

8. Machine for stacking corrugated sheets and the like in superposed edge-to-edge relation comprising a shingling conveyor having a driven endless belt for frictionally carrying said sheets in shingled relation, a transfer conveyor disposed in spaced end-to-end relation with the shingling conveyor and including a driven belt for supporting said sheets thereon, and for receiving said sheets from the shingling conveyor and frictionally carrying said sheets, a vertically movable platform disposed to receive sheets from the transfer conveyor, means for lowering said platform from a position approximately coplanar with said transfer coveyor as the height of the stack thereon increases, said machine having an automatic stack transfer cycle when said stack achieves a predetermined height, means for controlling the speed of sad shingling conveyor and said transfer conveyor and means operable for said stack transfer cycle for stopping movement of said sheets from the shingling conveyor onto the transfer conveyor and including means to arrest movement of sad sheets while the belt of said shingling conveyor is moving, said speed control means including means reducing the speed of said shingling conveyor and increasing the speed of said transfer conveyor in relation to the actuation of the said stop means whereby sheets are continuously moved toward said stop means by said shingling conveyor and discharged at increased speed by the transfer conveyor onto said vertically movable platform during said stack transfer cycle, said stop means including a first bar disposed in the space between the adjacent ends of said shingling and transfer conveyors which is movable to and from a level above and below the path of sheet movement across said space, said bar being provided with a surface for frictionally arresting movement of sheets engaged thereby when the bar is raised, a second stop bar disposed above said shingling conveyor and being movable toward and away from the upper surface of the conveyor, said second bar extending transversely across the width of said shingling conveyor to stop sheets moving thereon by abutment with the leading edges of said sheets whereby said latter sheets are prevented from moving to the first stop bar disposed in the space between said conveyors.

9. Machine for stacking said material as set forth in claim 8 in which the first stop bar has a sheet engaging surface of high coefficient of friction sufficiently greater than that of the surface of the shingling conveyor and in which said second stop bar includes a lower edge portion having a low coefficient of friction which exerts sufficiently light pressure of said sheet contacted thereby to enable said contacted sheets to slide under said second stop bar by the moving belt of said shingling conveyor.

* * * * *